US009032735B2

(12) United States Patent
Bellino et al.

(10) Patent No.: US 9,032,735 B2
(45) Date of Patent: May 19, 2015

(54) COMBUSTOR AND A METHOD FOR ASSEMBLING THE COMBUSTOR

(75) Inventors: Mark Carmine Bellino, Greenville, SC (US); David Edward Schick, Greenville, SC (US); Brian M. Leinonen, Anderson, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 547 days.

(21) Appl. No.: 13/456,636

(22) Filed: Apr. 26, 2012

(65) Prior Publication Data

US 2013/0283798 A1 Oct. 31, 2013

(51) Int. Cl.

| | |
|---|---|
| ***F23R 3/00*** | (2006.01) |
| ***B23P 11/00*** | (2006.01) |
| *F23R 3/28* | (2006.01) |

(52) U.S. Cl.

CPC ..... *F23R 3/286* (2013.01); *Y10T 29/49428* (2015.01); *F23R 3/00* (2013.01); *F23R 2900/00012* (2013.01)

(58) Field of Classification Search

CPC ..... F23R 3/00; F23R 2900/00
USPC ..... 60/722, 725, 747, 796, 798–800
See application file for complete search history.

(56) References Cited

U.S. PATENT DOCUMENTS

| | | | | |
|---|---|---|---|---|
| 4,528,432 | A | 7/1985 | Senba et al. | |
| 4,878,235 | A | 10/1989 | Anderson | |
| 4,924,756 | A | 5/1990 | Berube et al. | |
| 5,059,752 | A | 10/1991 | Inagaki | |
| 5,247,790 | A | 9/1993 | Donlan et al. | |
| 5,307,635 | A * | 5/1994 | Graves et al. | 60/740 |
| 6,257,282 | B1 | 7/2001 | Emmer et al. | |
| 6,260,754 | B1 | 7/2001 | Bazizi et al. | |
| 6,867,385 | B2 | 3/2005 | Stoving et al. | |
| 7,509,808 | B2 * | 3/2009 | Storey et al. | 60/740 |
| 7,926,178 | B2 | 4/2011 | Thomson et al. | |
| 8,375,726 | B2 * | 2/2013 | Wiebe et al. | 60/800 |
| 2003/0056511 | A1 * | 3/2003 | Bruck et al. | 60/723 |
| 2009/0145983 | A1 | 6/2009 | Stuttaford et al. | |
| 2010/0251720 | A1 | 10/2010 | Pelletier et al. | |
| 2011/0005230 | A1 | 1/2011 | Bailey et al. | |

* cited by examiner

*Primary Examiner* — Ehud Gartenberg
*Assistant Examiner* — Filippo Manfredi
(74) *Attorney, Agent, or Firm* — Dority & Manning, PA

(57) ABSTRACT

A combustor generally includes a plate that extends radially and circumferentially within at least a portion of the combustor. The combustor may also include a shroud that at least partially surrounds the plate and a plurality of tubes that extend through the plate. One or more flexible couplings may at least partially surround at least some of the plurality of tubes and the one or more flexible couplings may be connected to the plate.

14 Claims, 4 Drawing Sheets

COMBUSTOR AND A METHOD FOR ASSEMBLING THE COMBUSTOR

FIELD OF THE INVENTION

The present invention generally involves a combustor for a gas turbine and a method for assembling the combustor.

BACKGROUND OF THE INVENTION

Combustors are commonly used in industrial and power generation operations to ignite fuel to produce combustion gases having a high temperature and pressure. A typical gas turbine may include an axial compressor at the front, one or more combustors around the middle, and a turbine at the rear. A working fluid such as ambient air may be supplied to the compressor to produce a compressed working fluid at a highly energized state. The compressed working fluid exits the compressor and flows into a combustion chamber defined within the combustor where the compressed working fluid mixes with fuel and ignites to generate combustion gases having a high temperature and pressure. The combustion gases flow from the combustor into the turbine to produce work. For example, expansion of the combustion gases in the turbine may rotate a shaft connected to a generator to produce electricity.

In a particular combustor design, a plurality of tubes may be radially arranged within one or more tube bundles to provide fluid communication for the compressed working fluid and/or fuel to flow through the one or more tube bundles and into the combustion chamber. At least some of the plurality of tubes may extend through one or more plates that extend generally radially and circumferentially within each of the one or more tube bundles. In typical configurations, the tubes may be brazed and/or welded to the one or more plates so as to provide a seal between the tubes and the one or more plates. However, as the combustor cycles through various operating conditions, the joint between the tubes and the one or more plates may be compromised due to axial and radial thermal expansion and contraction of both the tubes and the plate. As a result, fuel and/or air may leak through the compromised joint. In addition or in the alternative, the compromised joint may significantly limit the mechanical life of the tubes and/or the plates due to combustor dynamics. Therefore, an improved combustor and method for assembling the combustor that compensates for the axial and/or the radial thermal expansion of the tubes and/or the plates while maintaining the seal between the tubes and the plates would be useful.

BRIEF DESCRIPTION OF THE INVENTION

Aspects and advantages of the invention are set forth below in the following description, or may be obvious from the description, or may be learned through practice of the invention.

One embodiment of the present invention is a combustor having a plate that extends radially and circumferentially within at least a portion of the combustor, a shroud that at least partially surrounds the plate, a plurality of tubes that extend through the plate, and one or more flexible couplings that at least partially surround at least some of the plurality of tubes and that are connected to the plate.

Another embodiment of the present invention is a combustor having a first plate that extends radially and circumferentially within at least a portion the combustor. A second plate extends generally radially and circumferentially within the combustor and the second plate is downstream from the first plate. A shroud extends between the first and second plates. A plurality of tubes extends through the first plate and the second plate, and one or more flexible couplings at least partially surround at least some of the plurality of tubes. The one or more flexible couplings are connected to the at least some of the plurality of tubes and to at least one of the first plate or the second plate.

The present invention may also include a method for assembling a combustor. The method generally includes aligning at least one flexible coupling with a passage that extends through a plate, connecting a first end of the flexible coupling to the plate, inserting a tube through the passage, and connecting a second end of the at least one flexible coupling to the tube.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
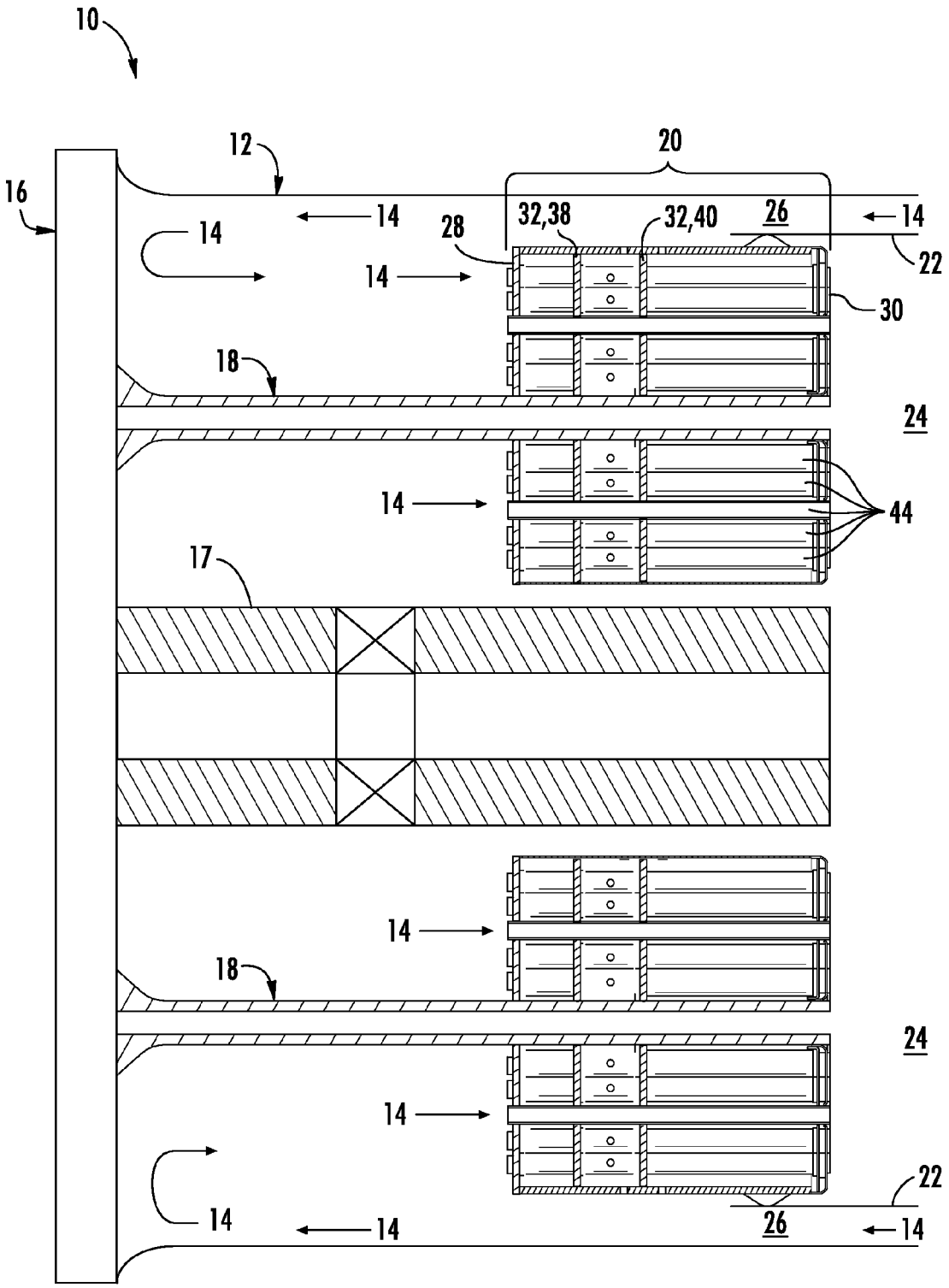
FIG. 1 illustrates a cross-sectional view of a combustor according to the present disclosure.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. In addition, the terms "upstream" and "downstream" refer to the relative location of components in a fluid pathway. For example, component A is upstream from component B if a fluid flows from component A to component B. Conversely, component B is downstream from component A if component B receives a fluid flow from component A.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention include a combustor and method for assembling the combustor. The combustor generally includes a tube bundle disposed within the combustor and in fluid communication with a fuel source. The tube bundle may include at least one plate that extends generally radially and circumferentially within at least a portion of the combustor. A shroud may at least partially surround the plate and a plurality of tubes may extend through the plate. One or more flexible couplings may at least partially surround at least some of the plurality of tubes and the one or more flexible couplings may be connected to the plate. In particular embodiments, the one or more flexible couplings may also be connected to the tubes so as to allow the tubes to expand and contract through the plate as the combustor cycles through various thermal conditions. Although exemplary embodiments of the present invention will be described generally in the context of a combustor incorporated into a gas turbine for purposes of illustration, one of ordinary skill in the art will readily appreciate that embodiments of the present invention may be applied to any combustor and are not limited to a gas turbine combustor unless specifically recited in the claims.

Figure 2:
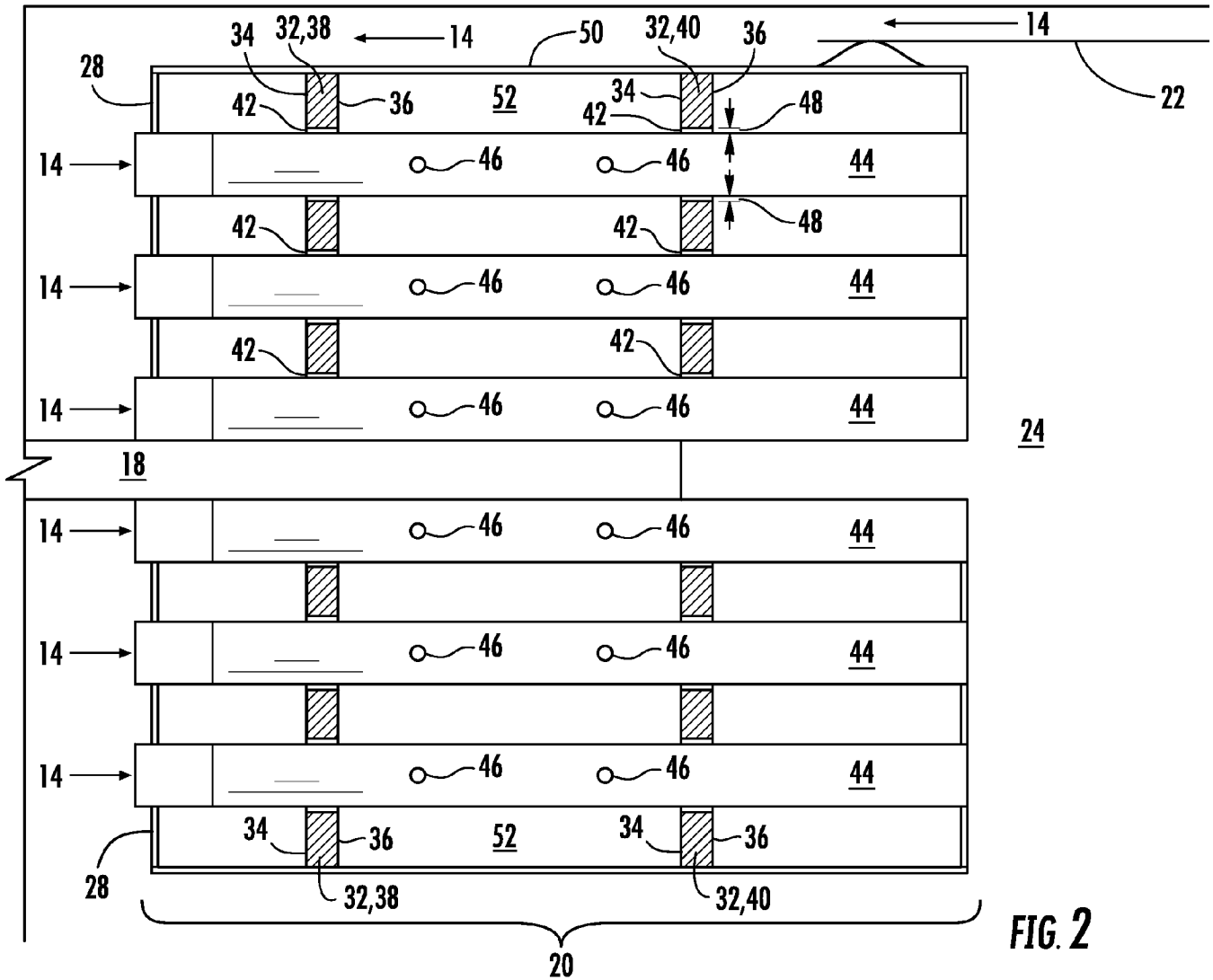
FIG. 2 illustrates an enlarged cross-sectional view of the combustor as shown in FIG. 1.
Figure 3:
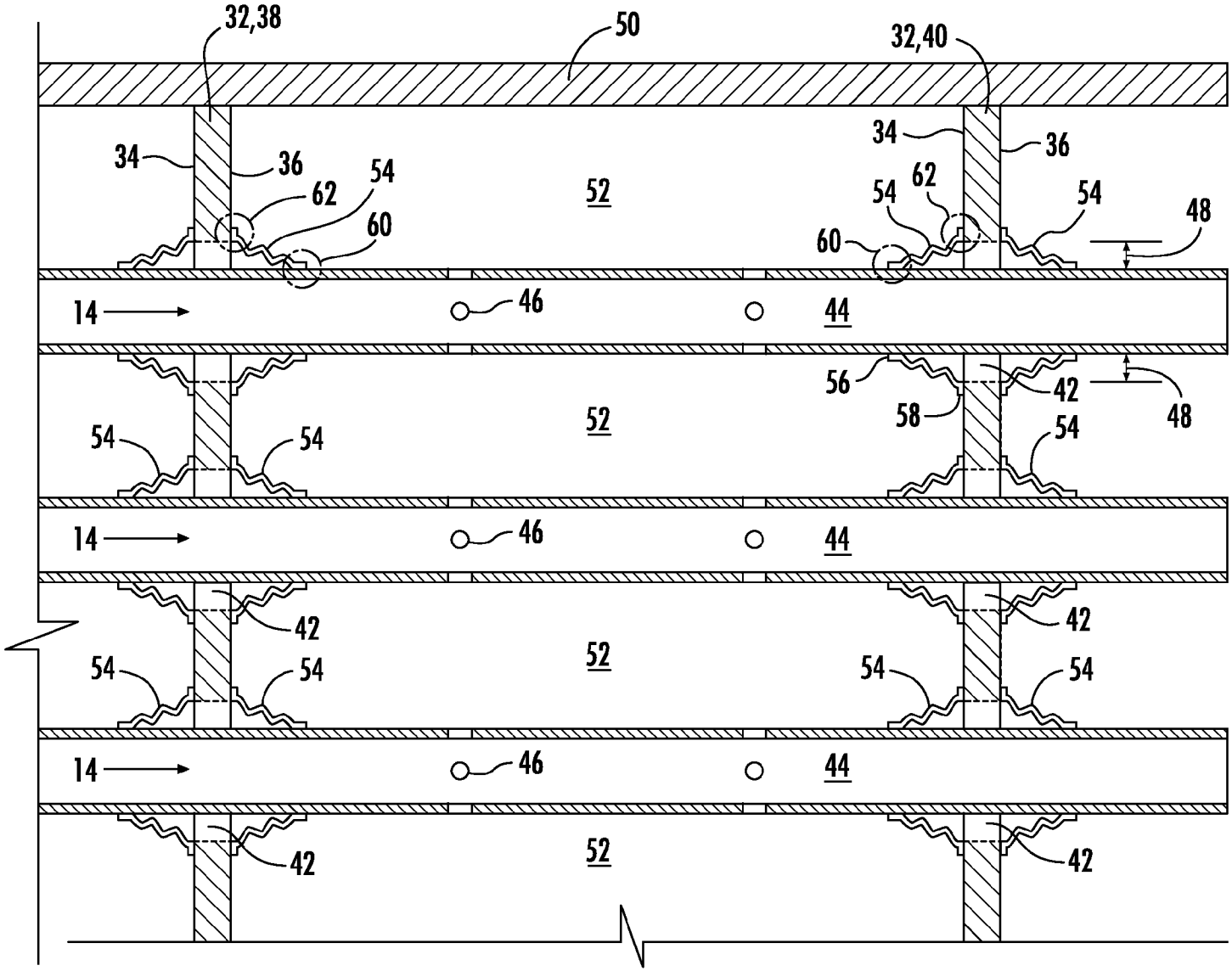
FIG. 3 illustrates an enlarged cross-sectional view of the combustor as shown in FIG. 2, according to at least one embodiments of the present disclosure.

FIG. 1 illustrates a simplified cross-sectional view of an exemplary combustor 10 according to at least one embodiment of the present disclosure, and FIGS. 2 and 3 provide enlarged cross-sectional views of the combustor as shown in FIG. 1. As shown in FIG. 1, a casing 12 generally surrounds the combustor 10 to contain a working fluid 14 flowing to the combustor 10. The casing 12 may include an end cover 16 at one end to provide an interface for supplying fuel, diluent, and/or other additives to the combustor 10. At least one fuel nozzle 17 may extend downstream from the end cover 16. The particular shape and size of the nozzle 17 may vary according to various operating requirements of the combustor 10.

As shown in FIGS. 1 and 2, one or more fluid conduits 18 may extend generally axially from the end cover 16 to at least one tube bundle 20 that is disposed downstream from the end cover. Although one tube bundle 20 is described in the disclosure, it should be obvious to one of ordinary skill in the art that the combustor 10 may include multiple tube bundles 20 of various shapes and sizes, with each tube bundle 20 in fluid communication with the one or more fluid conduits 18 disposed within the combustor 10. The one or more fluid conduits 18 may provide fluid communication between a fuel source (not illustrated) and the tube bundle 20. The tube bundle 20 may be configured to extend generally radially and circumferentially across at least a portion of the combustor 10.

A liner 22 generally surrounds at least a portion of the tube bundle 20 and extends generally downstream from the tube bundle 20. The liner 22 at least partially defines a combustion chamber 24 downstream from the tube bundle 20. As shown in FIG. 1, the casing 12 circumferentially surrounds the tube bundle 20 and/or the liner 22 to define an annular passage 26 that at least partially surrounds the tube bundle 20 and the liner 22. In this manner, the working fluid 14 may flow through the annular passage 26 along the outside of the liner 22 to provide convective cooling to the liner 22. When the working fluid 14 reaches the end cover 16, the working fluid 14 may reverse direction and flow through at least a portion of the tube bundle 20 where it may mix with the fuel before it is injected into the combustion chamber 24.

As shown in FIGS. 1 and 2, the tube bundle 20 generally includes an upstream end 28 axially separated from a downstream end 30. As shown in FIGS. 1-4, the tube bundle 20 generally includes one or more plates 32 downstream from the tube bundle 20 upstream end 28. Each of the one or more plates 32 extends generally radially and circumferentially within at least a portion of the tube bundle 20 and/or the combustor 10. As shown in FIGS. 1-4, each of the one or more plates 32 has an upstream surface 34 axially separated from a downstream surface 36. In particular embodiments, the one or more plates 32 may comprise of a first plate 38 proximate to the tube bundle 20 upstream end 28 (shown in FIGS. 1 and 2), and a second plate 40 downstream from the first plate 38. Each of the one or more plates 32 may be of any thickness and may be made from any material designed to withstand the operating environment within the combustor 10.

Figure 4:
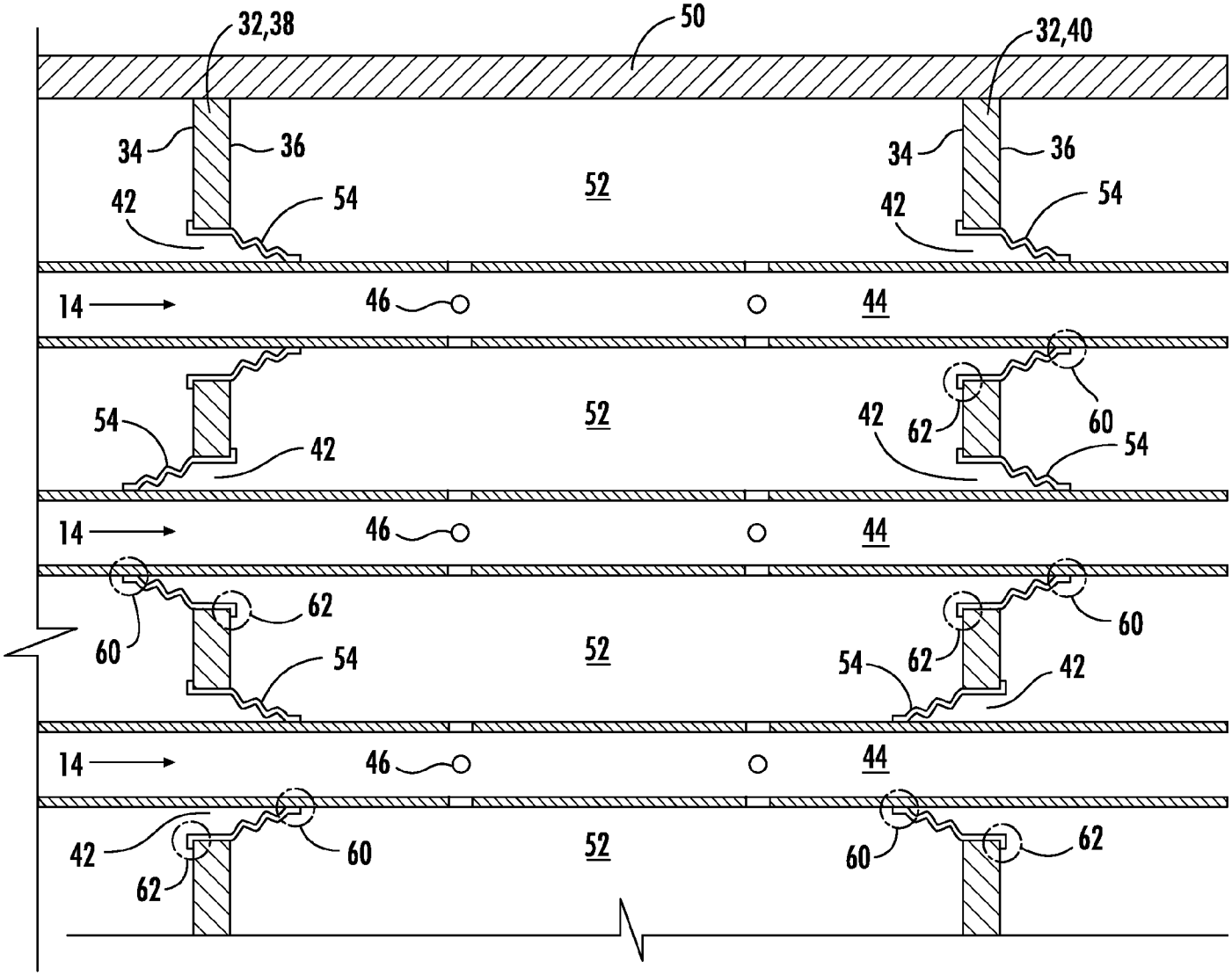
FIG. 4 illustrates an enlarged cross-sectional view of the combustor as shown in FIG. 2, according to at least one embodiment of the present disclosure.

As shown in FIGS. 2-4, a plurality of passages 42 may extend generally axially through each of the one or more plates 32. The plurality of passages 42 may be of any size or shape. A plurality of tubes 44 extend generally axially through at least one of the one or more plates 32. In particular embodiments, at least some of the plurality of tubes 44 extends through the plurality of passages 42. The particular shape, size, number, and arrangement of the tubes 44 may vary according to combustor 10 requirements. For example, the plurality of tubes 44 are generally illustrated as having a cylindrical shape; however, alternate embodiments within the scope of the present disclosure may include tubes 44 having virtually any geometric cross-section. In various embodiments, a plurality of fuel ports 46 may extend through at least some of the plurality of tubes 44 to allow fluid communication through the tubes 44. In particular embodiments, a radial gap 48 may be defined between the one or more plates 32 and the plurality of tubes 44. In addition or in the alternative, the plurality of tubes 44 may be pressed into the passages 42 so that the radial gap 48 is minimal or is zero.

As shown in FIGS. 2-4, a shroud 50 may at least partially surround the one or more plates 32. In particular embodiments, the shroud 50 may extend from the first plate 38 to the second plate 40. A plenum 52 may be at least partially defined between the first plate 38, the second plate 40 and the shroud 50. In particular embodiments, the plenum 52 may be in fluid communication with at least one of the one or more fluid conduits 18. In this manner, fuel may flow through the one or more fluid conduits 18 into the plenum 52. The fuel may then flow through the plurality of fuel ports 46 and into at least some of the plurality of tubes 44. In this manner, the fuel may mix with the working fluid 14 flowing through the tubes 44 of the tube bundle 20 before being injected in the combustion chamber 24 for ignition.

In particular embodiments, as shown in FIGS. 3 and 4, one or more flexible couplings 54 may at least partially surround at least some of the plurality of tubes 44. Each of the one or more flexible couplings 54 may include a first end 56 separated from a second end 58. The first end 56 of the one or more flexible couplings 54 may be connected to at least some of the plurality of tubes 44 that extend through the one or more plates 32. In particular embodiments, the connection between the first end and the at least some of the plurality of tubes 44 may provide a seal 60 between the first end 56 of the flexible coupling 54 and the at least some of the plurality of tubes 44. The first end 56 may be connected to the at least some of the plurality of tubes 44 by any manner known in the art. For example, but not limiting of, the first end 56 may be brazed and/or welded to the at least some of the plurality of tubes 44.

The second end 58 of the one or more flexible couplings 54 may be connected to the upstream surface 34 and/or the downstream surface 36 of the one or more plates 32. For example, but not limiting of, the second end 58 may be brazed and/or welded to the plate 32. In particular embodiments, the connection between the flexible coupling 54 second end 58 and the upstream and/or downstream surfaces 34, 36 of the one or more plates 32 may provide a seal 62 between the flexible coupling 54 second end 58 and the one or more plates 32. The one or more flexible couplings 54 may be any type, shape or size that may allow the tubes to move generally axially relative to the plate 32 and/or the plate passages 38. In this manner, as the tubes 44 expand due to thermal growth during operation of the combustor 10, the tubes 44 may be allowed to grow axially through the plate 32 and/or the plate passages 42 without compromising the seals 60 & 62. In particular embodiments, the one or more flexible couplings 54 may be bellows shaped. For example, but not limiting of, the one or more bellows shaped flexible couplings 54 may be may be of an annular type or a spiral type bellows.

In particular embodiments, as shown in FIG. 3, at least some of the one or more flexible couplings 54 may be coupled to the one or more plates 32 upstream surface 34. In addition or in the alternative, at least some of the one or more flexible couplings 54 may be connected to the one or more plates 32 downstream surface 36. In certain embodiments, at least some of the one or more flexible couplings 54 may be connected to the first plate 38 downstream surface 36 and at least some of the flexible couplings 54 may be connected to the second plate 40 upstream surface 34. In alternate embodiments, at least some of the one or more flexible couplings 54 may be connected to the first plate 38 upstream surface 34 and at least some of the one or more flexible couplings 54 may be connected to the second plate 40 downstream surface 36. In further embodiments, at least some of the one or more flexible couplings 54 may be connected to the first plate 38 upstream surface 34 and at least some of the one or more flexible couplings 54 may be connected to the second plate 40 upstream surface 34.

As shown in FIG. 4, in various embodiments, at least some of the one or more flexible couplings 54 may be connected to the upstream surface 34 or the downstream surface 36 of the one or more plates 32 and may extend through at least some of the plurality of passages 42. For example, in particular embodiments, at least some of the one or more flexible couplings 54 may be connected to the first plate 38 upstream surface 34 and may extend through the plurality of passages 42 that extend through the first plate 38, and at least some of the one or more flexible couplings 54 may be connected to the second plate 40 upstream surface 34 and extend through the plurality of passages 42 that extend through the second plate 40. In addition or in the alternative, at least some of the one or more flexible couplings 54 may be connected to the first plate 38 downstream surface 36 and extend through the plurality of passages 42 that extend through the first plate 38, and at least some of the one or more flexible couplings 54 may be connected to the second plate 40 upstream surface 34 and extend through the plurality of passages 42 that extend through the second plate 40. In addition or in the alternative, at least some of the one or more flexible couplings 54 may be connected to the first plate 38 upstream surface 34 and extend through the plurality of passages 42 that extend through the first plate 38, and at least some of the one or more flexible couplings 54 may be connected to the second plate 40 downstream surface 36 and extend through the plurality of passages 42 that extend through the second plate 40. Although certain configurations are described, it should be obvious to one of ordinary skill in the art that the one or more flexible couplings 54 may be connected in any configuration that allows the plurality of tubes 44 to expand and contract through the passages 42 without compromising the seals 60, 62 and/or the connections between the tubes 44 and the one or more plates 32, 38 and 40.

The various embodiments shown in FIGS. 1-4 may also provide a method for assembling the combustor 10. In particular embodiments, the method may include aligning at least one of the flexible couplings 54 with one of the plurality of passages 42 that extend through at least one of the one or more plates 32, connecting a first end of each flexible coupling 54 to the plate 32, inserting one of the plurality of tubes 44 through each passage 42, and connecting a second end of each flexible coupling 54 to the one of the plurality of tubes 44. In further embodiments, the method may further include sealing the second end of each of the plurality of flexible couplings 54 to each of the tubes 44. The method may also include sealing the first end of each of plurality of flexible couplings 54 to the plate 32. This may include both the first and/or second plates 38, 40 as previously disclosed. The method may also include welding the first end of each of the flexible couplings 54 to the plate 32, 38 or 40 and/or brazing the first end of each flexible coupling 54 to the plate 32, 38 or 40. In further embodiments, the method may include welding and/or brazing the second end of each flexible coupling 54 to the tubes 44.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal languages of the claims.

What is claimed is:

1. A combustor comprising:

a. a plate that extends radially and circumferentially within at least a portion of the combustor;

b. a shroud that at least partially surrounds the plate;

c. a plurality of tubes, each tube penetrating through a corresponding hole defined within the plate; and d. a flexible coupling that surrounds one tube of the plurality of tubes, wherein the flexible coupling is fixedly and sealingly connected at a first end to the one tube and at a second end to the plate, and wherein the one tube moves through the hole in the plate.

2. The combustor as in claim 1, wherein the flexible coupling is a bellows coupling.

3. The combustor as in claim 1, wherein the flexible coupling is at least one of brazed and welded to the plate.

4. The combustor as in claim 1, wherein the flexible coupling is at least one of brazed and welded to the one tube of the plurality of tubes.

5. The combustor as in claim 1, wherein each of the plurality of tubes is surrounded by at least one flexible coupling.

6. The combustor as in claim 1, further comprising a radial gap defined between the plate and the one tube of the plurality of tubes, wherein the flexible coupling extends through the radial gap.

7. The combustor as in claim 1, wherein the plate includes an upstream surface axially separated from a downstream surface, and the flexible coupling is connected to the upstream surface.

8. A combustor comprising:

a. a first plate that extends radially and circumferentially within at least a portion of the combustor;

b. a second plate that extends radially and circumferentially within the combustor, the second plate downstream from the first plate;

c. a shroud that extends between the first and second plates;

d. a plurality of tubes that penetrate through the first plate and the second plate, the plurality of tubes comprising a first tube;

e. a first flexible coupling that surrounds the first tubes, wherein the first flexible coupling is fixedly and sealingly connected to the first tube and the first plate, wherein the first tube moves through the first plate; and f. a second flexible coupling that surrounds the first tube, wherein the second flexible coupling is fixedly and sealingly connected to the first tube and the second plate, wherein the first tube moves through the second plate.

9. The combustor as in claim 8, wherein at least one of the first flexible coupling and the second flexible coupling is a bellows coupling.

10. The combustor as in claim 8, wherein at least one of the first flexible coupling and the second flexible coupling is brazed or welded to the first or second plates.

11. A method for assembling a combustor, the method comprising:

a. aligning at least one flexible coupling with a passage that extends through a plate;

b. connecting fixedly and sealingly a first end of the at least one flexible coupling to the plate;

c. inserting a tube through the passage; and d. connecting fixedly and sealingly a second end of the at least one flexible coupling to the tube, wherein the at least one flexible coupling provides for movement of the tube through the passage of the plate.

12. The method as in claim 11, wherein connecting the first end of each flexible coupling to a separate passage, further comprises welding the first end of each of each flexible coupling to the plate.

13. The method as in claim 11, wherein connecting the first end of each flexible coupling to a separate passage, further comprises brazing the first end of each flexible coupling to the plate.

14. The method as in claim 11, wherein connecting the second end of each flexible coupling to a separate tube, further comprises brazing the second end of each flexible coupling to the tube.

* * * * *